US006397852B1

(12) United States Patent
McAdam

(10) Patent No.: US 6,397,852 B1
(45) Date of Patent: Jun. 4, 2002

(54) SMOKABLE FILLER MATERIAL FOR SMOKING ARTICLES

(75) Inventor: Kevin Gerard McAdam, Southampton (GB)

(73) Assignee: British-American Tobacco (Investments) Limited, Staines (GB)

( * ) Notice: Subject to any disclaimer, the term of this patent is extended or adjusted under 35 U.S.C. 154(b) by 0 days.

(21) Appl. No.: 09/142,240

(22) PCT Filed: Mar. 4, 1997

(86) PCT No.: PCT/GB97/00589

§ 371 (c)(1),
(2), (4) Date: Sep. 3, 1998

(87) PCT Pub. No.: WO97/32492

PCT Pub. Date: Sep. 12, 1997

(30) Foreign Application Priority Data

Mar. 7, 1996 (GB) ..... 9605117

(51) Int. Cl.[7] ..... A24B 15/00

(52) U.S. Cl. ..... 131/352; 131/353; 131/354; 131/355; 131/356; 131/357; 131/359; 131/275; 131/276

(58) Field of Search ..... 131/352, 353, 131/354, 355, 356, 357, 359, 275, 276

(56) References Cited

U.S. PATENT DOCUMENTS

| | | | | | |
|---|---|---|---|---|---|
| 3,894,543 | A | * | 7/1975 | Anderson et al. | 131/2 |
| 3,931,824 | A | * | 1/1976 | Miano et al. | 131/2 |
| 3,934,594 | A | * | 1/1976 | Beringer et al. | 131/2 |
| 4,008,723 | A | * | 2/1977 | Borthwick et al. | 131/2 |
| 4,197,861 | A | * | 4/1980 | Keith | 131/2 |
| 5,046,514 | A | * | 9/1991 | Bolt | 131/359 |
| 5,540,242 | A | * | 7/1996 | Chao et al. | 131/365 |
| 5,598,868 | A | * | 2/1997 | Jakob et al. | 131/359 |

FOREIGN PATENT DOCUMENTS

| | | | | |
|---|---|---|---|---|
| GB | 1170858 | * | 11/1969 | 131/2 |

* cited by examiner

*Primary Examiner*—Stanley S. Silverman
*Assistant Examiner*—M. Halpern
(74) *Attorney, Agent, or Firm*—Pitney, Hardin, Kipp & Szuch LLP

(57) ABSTRACT

A smokeable filler material which includes casing material as a fuel material, along with an inorganic filler, a binder and an aerosol generating source. This material has good taste and flavour characteristics and contains relatively little tobacco material.

19 Claims, No Drawings

SMOKABLE FILLER MATERIAL FOR SMOKING ARTICLES

This invention relates to smokable filler material for smoking articles, and in particular to filler material which may not necessarily comprise any tobacco filler material.

In the many efforts which have been made to provide alternative smokable filler materials very few, if any, materials have been found which produce a smoke taste and flavour which is acceptable to smokers of conventional tobacco containing products. Therefore, most alternative filler materials have been used in conjunction with cut tobacco leaf or tobacco-containing reconstituted products. However, even in this form the unacceptable taste of these filler materials is noticeable and detracts from smoking pleasure.

BACKGROUND OF THE INVENTION

UK Patent Specification No. 1 412 878 describes a tobacco substitute material which comprises a large proportion of non-tobacco, organic filler material in conjunction with, amongst others, an inorganic filler, binder and plasticiser materials. The concept of using casing materials as a flavourful fuel component, rather than a top-flavouring, is not contemplated therein.

U.S. Pat. Nos. 4,197,861 and 3,931,824, and UK Patent Specification No. 1,170,858 disclose tobacco substitute materials comprising inorganic filler and a film forming ingredient, with an optional amount of plasticiser. The aerosol content of these materials make them undesirable as the sole smokable filler material.

U.S. Pat. No. 4,008,723 discloses a tobacco substitute material containing a minimum amount of organic combustible material and a maximum amount of inorganic filler, and sometimes a thermally degraded cellulose material which comprises substantially carbon after treatment. Glycerol is in all instances present as a plasticiser for the smoking composition. Where citric acid is present, probably as a combustion modifier, rather than as a casing material, the amount is always greater than 1%.

U.S. Pat. No. 3,894,543 describes a film tobacco substitute comprising inorganic filler, binder and plasticiser (glycerol). Again, as in all the previous art cited, the concept of using casing materials as the flavourful fuel component is not contemplated.

Commonly used in tobacco filler materials are casing materials applied as a casing sauce to the tobacco blend, usually before cutting of the blended material occurs. The casing sauce can include materials such as sugars, humectants and aromatic substances, such as flavours. Casing materials can also include less volatile flavour materials, such as the materials derived from cocoa beans, vanilla beans, tonka beans and deer tongue, for example. Casing materials are commonly added to tobacco at an application level of 3–10%.

SUMMARY OF THE INVENTION

This invention seeks to provide a tobacco substitute material which utilises one or more of the group known as casing materials as a fuel material in a smokable filler material.

DETAILED DESCRIPTION OF THE PREFERRED EMBODIMENT

It is an object of the present invention to provide a smokable filler material with acceptable taste and flavour characteristics for the consumer, which smokable filler material contains little tobacco, and preferably no tobacco, therein.

It is a further object of the invention to provide a smokable filler material which has acceptable taste and flavour characteristics and is thus suitable for inclusion with tobacco material, if desired, without detracting from the taste and flavour of the natural tobacco products. Alternatively, the filler material may comprise 100% of the smoking article filler material.

The present invention provides a smoking article smokable filler material comprising a non-tobacco fuel material comprising one or more casing materials, a substantially non-combustible inorganic filler, an aerosol generating source, and a binder.

Preferably, where the casing material is caramel the caramel is used in combination with at least one other casing material.

Carbon, an expansion medium and an organic filler may all be optional additional materials suitable for use in the filler material, depending on the final product characteristics required. For example, a foamed or non-foamed, i.e. expanded, product would additionally comprise an expansion medium, such as starch, in an appropriate amount.

The carbon may be present in an amount up to about 20%, the expansion medium may be present in an amount up to 30%, all dry weight of the dry materials in the mixture.

The smoking article smokable filler material may preferably comprise about 10% to about 70% casing material, about 2% to about 30% aerosol generating source, about 5% to about 80% inorganic filler material, about 5% to about 25% binder, 0 to about 30% expansion medium and 0 to about 20% carbon.

Preferably the total casing material is less than 50%, more preferably less than 40% and even more preferably less than 30%, by weight of the smokable filler material.

Suitably when the casing material comprises more than one casing material and includes cocoa, the cocoa is the larger portion of the casing material.

Preferably the amount of aerosol generating material is about 15% or less, by weight of the smokable filler material.

Preferably the amount of inorganic filler material is more than about 30%, more preferably more than about 40%, and even more preferably more than about 50%, by weight of the smokable filler material.

Preferably the amount of binder is less than 15% by weight of the smokable filler material, if the binder is not pectin.

Preferably the amount of sugar, if present, is less than 15% by weight of the smokable filler material.

Advantageously the casing material comprises at least two or three individual casing materials and may comprise up to about seven or eight casing materials.

The smokable filler material may suitably comprise 10–68% total casing material, which may be comprised of 0–15% licorice, 0–50% cocoa, 0–13% propylene glycol, 0–26% sugar, 0–6% honey, 0–1% St. Johns Bread, 0–1% tartaric acid, 0–13% glycerol and 9–67% chalk.

The better known casing materials are sugars and related materials, such as cane sugar, invert sugar, fruit sugar from fruit juices, such as prune juice for example, demerara sugar, maple sugar, sucrose, honey, caramel and molasses; humectants such as propylene glycol, glycerol, diethylene glycol, butylene glycol and sorbitol; distilled water, licorice, coffee, vanillin, apple derivatives, clove, cocoa, St. John's Bread, and acids, such as citric and tartaric acids, for example. Other suitable casing materials will be known to the skilled man.

The proportion of casing material utilised will depend on the smoke taste and flavour produced, and by the requirement, if any, to produce a low sidestream smokable filler material. The nature of the smoking article wrapper utilised with the smokable filler material will also be a determinant of the composition of the filler material, as well as the permeability of the wrapper material.

Top flavour compositions are also used on smoking material. Advantageously the smokable filler material of the present invention also comprises one or more of a top flavour typical of those used on cigarette tobacco filler material in order to provide a taste and flavour similar to that of a conventional tobacco-containing cigarette.

Preferably the smokable filler material is a substantially non-tobacco material. As used herein, the term substantially non-tobacco material should be taken to mean containing about 5% or less tobacco material by weight of the filler, more preferably less than 3% by weight tobacco material, and even more preferably no tobacco material therein.

Advantageously the casing material mixture may be subjected to a pre-treatment step before sheet formation, which step may comprise heating to about 140° C. for about 6 minutes.

Advantageously tobacco extract material may be included in the casing material fuel. The tobacco extract material may suitably be in a purified form or a synthetic analogue of the tobacco extract in whole or in part.

Preferably, the non-combustible inorganic filler is selected from those materials described in our co-pending PCT application. An organic filler may also substitute for a proportion of the inorganic filler, or be used alone as the filler material. The subject matter of our co-pending PCT Application NO. PCT/GB 95/02110 relating to suitable inorganic and organic materials for the present invention is to be considered as incorporated herein by reference thereto. This PCT application will be known herein as our co-pending PCT application. The non-combustible inorganic materials include, such as for example, chalk, perlite, vermiculite, diatomaceous earth, colloidal silica, magnesium oxide, magnesium sulphate or other low density, non-combustible, inorganic filler materials known to those skilled in the art. Organic fillers include inorganic salts of organic acids, polysaccharide material, or, for example, organic binder material, present at a level greater than the level required for that material to act purely as a binder.

Suitable binder materials for the present invention include the well known cellulosic or cellulosic derivative binders, alginic or pectinaceous binders, all of which are described in our co-pending PCT application, particularly in relation to the non-combustible wrapper thereof. The binder may be an organic binder, for example, cellulose derivatives, such as sodium carboxymethyl cellulose, methyl cellulose, hydroxypropyl cellulose, hydroxyethyl cellulose or cellulose ethers, alginic binders including soluble alginates such as ammonium alginate, sodium alginate, sodium calcium alginate, calcium ammonium alginate, potassium alginate, magnesium alginate, triethanol-amine alginate and propylene glycol alginate, or insoluble alginates which can be rendered soluble by the addition of solubilising agents, such as ammonium hydroxide. Examples of these include aluminium, copper, zinc and silver alginates. Alginates which are initially soluble but which, during processing, undergo treatment to render them insoluble in the final product may also be used, e.g. sodium alginate going to calcium alginate. Other organic binders include gums such as gum arabic, gum ghatti, gum tragacanth, Karaya, locust bean, acacia, guar, quince seed or xantham gums, or gels such as agar, agarose, carrageenans, fucoidan and furcellaran. Pectins and pectinaceous materials can also be used as binders. Starches can also be used as organic binders. Other suitable gums can be selected by reference to handbooks, such as Industrial Gums, Ed. Whistler (Academic Press). Inorganic non-combustible binders, such as potassium silicate, magnesium oxide in combination with potassium silicate, or some cements, for example, and mixtures thereof, may also be used, usually in the alternative. Combinations of all of the above may also be used.

The aerosol generating source preferably comprises aerosol forming means, such as glycerol and/or other aerosol forming compounds illustrated in our co-pending PCT application. These include polyhydric alcohols, propylene glycol and triethylene glycol, esters such as triethyl citrate, triacetin or triethylene glycol diacetate (TEGDA), or high boiling point hydrocarbons. Other suitable aerosol forming means will be known to those skilled in the art.

As indicated above, the smokable filler material may suitably be an extruded material, which extruded material may be a foamed or non-foamed material. Suitable expansion mediums or foaming means are described in our co-pending PCT application, the subject matter thereof in relation to expansion mediums being incorporated herein by reference thereto. Suitable expansion mediums include starch, pullulan or other polysaccharides, including cellulose derivatives, solid foaming agents, inorganic salts and organic acids providing in situ gaseous agents, organic gaseous agents, inorganic gaseous agents and volatile liquid foaming agents. Water is most commonly the preferred volatile expansion agent for such expansion systems. Alternative expansion agents are well known. The extruded material may be rods, strands, filaments or sheet material which is then cut to provide filler material. Alternatively the smokable filler material may be cast as a sheet using known conventional band casting or paper making techniques. Entwining or twisting of the strands or filaments may be desirable to provide air passages, if the extruded material does not allow the drawing of air or smoke therealong. Other downstream processing techniques may also be used to improve pressure drop. Various extruded forms are described in our co-pending PCT application and should be taken to be incorporated herein by reference thereto.

The smokable filler material may advantageously also comprise carbon material, activated or not. Preferably the carbon material is powdered or granular carbon material.

Plasticisers, such as glycerol, propylene glycol, or other well known plasticisers, may optionally be present at levels at which they do not become the main aerosol component of the smoke.

Smoking article filler material according to the invention may be used with conventional tobacco filler material or other tobacco substitute material as a diluent or a means of lowering the static peak burning temperature of the cigarette rod. It may also be used alone as the smoking article filler material.

Smoking article filler material according to the invention is suitable for use in conventional paper wrapped smoking articles, as well as in the alternative smoking article wrapper described in our co-pending PCT application. The subject matter of our PCT application relating to smoking article wrappers is incorporated herein by reference. The smoking article filler material is also suitable for use in the alternative smoking articles described by R. J. Reynolds in their patent applications deriving from U.S. Ser. No. 650,604 filed Sep. 14, 1984 and U.S. Ser. No. 684,537 filed Dec. 21, 1984, as either the aerosol generating means or the solid fuel element in those devices known as 'Premier'-type devices. Indeed, it may also be suitable in other aerosol delivery articles. The present material may partially or fully replace the materials described in those US specifications, and others deriving therefrom. The filler material of the present invention may also be known as a fuel source material.

The invention also provides a smoking article comprising a wrapper enwrapping a rod of smokable filler material as described above.

Advantageously the wrapper is a substantially non-combustible wrapper such as that described in our co-pending PCT application. The subject matter thereof relating to the substantially non-combustible wrapper is to be considered as incorporated herein by reference thereto. In summary, the wrapper comprises predominantly non-combustible, particulate, inorganic filler material, a binder, and/or a plasticiser, and optionally a small amount of fibre. These materials have all been described above.

Preferably the substantially non-combustible wrapper is comprised of predominantly non-combustible inorganic filler material. The term 'predominantly' as used herein means at least about 65% and usually 70%. The inorganic filler material advantageously yields very little or substantially no visible sidestream smoke when the smoking article is lit. Preferably the non-combustible wrapper comprises at least 80%, and more preferably at least 90% inorganic filler material by weight of the wrapper.

The non-combustible wrapper may comprise a small amount of cellulosic fibre material. Preferably the fibre material comprises less than 10%, more preferably less than 5%, and even more preferably less than 2% by weight of the non-combustible wrapper. Most advantageously the fibre material is not present in the wrapper.

Preferably the wrapper comprises a binder and/or a plasticiser. These components may be present at up to 30% by weight of the wrapper. Advantageously the binder is not present at more than 25% by weight of the wrapper. The exact proportions will depend on the taste characteristics, acceptable visible sidestream smoke emission and strength of the desired product, and the processing techniques used. The binder may be present at about 8–10% by weight of the wrapper, although it may be present at about 5% or less by weight of the wrapper.

The wrapper, although not giving much, if any, visible sidestream smoke, does produce an ash of an acceptable colour and quality. The smoking article also has a visible burn line which advances along the article and enables the smoker to determine whether the article is alight and to monitor the smoking process. The visible burn line may be formed as a result of burning the organic binder. Alternatively, colour changing compounds can be included in the wrapper composition. Colourants which give the wrapper an other than white colour may also be included. These colourants may also change colour as heating occurs, providing a visible burn line, e.g. $CuSO_4.5H_2O$.

The nature of the binder selected will also determine the permeability of the outer wrapper. Binders, such as sodium carboxymethyl cellulose and propylene glycol alginate, have been found to be particularly effective at producing an outer wrapper sufficiently permeable to sustain combustion of the fuel source within the wrapper. The latter binder gave the more permeable outer for the same outer wrapper composition. Hydration time of some binders can play a part in determining the efficacy of the binders. Conventionally understood strong binders such as hydroxypropyl cellulose can be used at lower levels to increase the wrapper permeability but this has to be balanced against the strength of the wrapper.

The plasticiser may be present in the wrapper at up to 20% by weight thereof. The plasticiser is preferably present at about 10% or less, preferably 5% or less, by weight of the wrapper. The plasticiser may be glycerol, propylene glycol, or low melting point fats or oils for example. Depending on the method of production selected for the wrappers, the plasticiser may be absent from the wrapper composition. The plasticiser helps in the drying stages of the wrapper to prevent shape distortion, particularly if direct heat, e.g. hot air, is the drying medium. The amount of plasticiser, binder or other organic filler material will affect the appearance of the burn line, i.e. the burn line width, and the amount of visible sidestream of the article. Preferably the width of the burn line is not greater than 10 mm, is preferably not more than 5 mm and more preferably is between 2–3 mm in,width. The width of the burn line depends on the composition of the burnable material in the article.

In order that the invention may be easily understood and readily carried into effect the following examples were performed to illustrate the invention and aspects thereof.

EXAMPLE 1

A number of smokable filler material preparations were made in accordance with the amounts given in Table 1 below. The dry material were each mixed with the syrupy sugars and other liquid materials, along with 230 ml of water. The binder, in each case propylene glycol alginate, was pre-hydrated. The total solids in each mixture, excluding water, was an amount of 100 g, thus the percentage figures given in the Table also equate to grams.

With respect to the glycerol present in the mixtures, the total amount of glycerol includes an amount of glycerol normally present in a casing as a humectant, say 3% by weight, or in the mixtures of Table 1 say 3 g, plus an additional amount, say 10% by weight of the total solids (excluding water), i.e. 10 g in the mixtures of Table 1, as the aerosol generating source. It will be understood that one of the other usual humectant materials found in the casing sauce could be used in a smokable filler mixture according to the invention as a humectant, along with the same or another material in a larger amount as an aerosol generating source.

The wet mixture was then extruded on to plastic sheets through a syringe having a circular nozzle of 1 mm diameter to produce strands of the filler material. The strands were left to dry in air at room temperature overnight. Strands of sample No. 1 were used to fill a 69 mm long outer wrapper, known hereinafter as outers, prepared as described below. The weights of filler material and outer are given in Table 1. Likewise, successive outers were filled with strands from successive samples. The filled outers were joined to a 27 mm long filter element of fibrous cellulose acetate having a pressure drop of 70 mm WG and then smoked under standard machine smoking conditions of a 35 $cm^3$ puff of 2 seconds duration every minute to a butt length of 35 mm, including the filter element. The results are shown in Table 2.

The results show high smoke deliveries of total particulate matter and a relatively high puff number for the length of cigarette produced. This can be attributed to the lack of tobacco which has its own natural burn control substances therein which regulate the puff numbers. Conventional cigarette design techniques can be utilised to produce the desired level of smoke delivery and puff number. For example, increasing the permeability of the outer wrapper can be the means used to decrease the puff number. Other methods, such as utilising burn control additives or changing the overall level of materials, for example, will be known to the skilled man.

The smoking articles produced provided a flavourful smoke which was comparable to conventional tobacco-filled cigarettes. It was observed that the level of sugars utilised significantly affects the taste and flavour of the smoking articles. Lower levels of sugar are preferred.

In Examples 2 and 3 fuel materials were prepared by mixing the solid particulate ingredients in a food blender. The liquid components were added while the solid components were being rapidly stirred in order to ensure thorough mixing. After all the water had been added the mixture was stirred for 30 minutes to allow the binder sufficient time for complete hydration. The resulting slurry was cast onto a heated stainless steel rotating drum which was maintained at a temperature of 105° C. The slurry was introduced onto the drum through a slit of 0.75 mm width. The dried sheet material was collected from the drum in sheet form conditioned at 60% relative humidity overnight and shredded through an office shredder. The resulting strands were similar in size to tobacco strands.

The samples were then assembled into paper-wrapped cigarettes 84 mm long, with a 27 mm cellulose acetate filter and 32 mm tipping. The cigarettes were smoked under standard ISO machine smoking conditions as described above to a 35 mm butt length. Smoke deliveries were obtained gravimetrically using a Cambridge filter pad.

EXAMPLE 2

Table 3 provides further mixtures where only one casing material is used as the fuel material.

The smoke delivery data illustrates the effectiveness of these casing materials as fuel material capable of producing smoke. In the tables the fuel composition figures are given in grams but in the proportions given can equally be thought of as percentage figures.

EXAMPLE 3

In the addition of casing materials to the tobacco blend it is usual to pre-treat the casing. The following samples show the effect of such a pre-treatment step in an effort to mimic the taste and flavour effects which the casings have in their normal application. In Samples 23 and 26 a small amount of tobacco dust in substitute for chalk was added to a blend which in all other respects is the same as Sample 11 above. Similarly, Samples 24 and 25 comprise tobacco extract and a synthetic analogue of a fraction of a tobacco extract in order to attempt to mimic the processes seen in conventional tobacco usage of casing material.

In Sample 23, 5 g of tobacco dust and 100 ml water was mixed with the dry casing mix. In Sample 24 the tobacco extract was prepared by extracting 5 g Virginia tobacco in 150 ml boiling water. After half hour 100 ml was decanted and mixed with the dry casing fuel mix. In Sample 25 0.5 g of a synthetic analogue of a fraction of a tobacco extract was added to the dry mix with 100 ml water.

In Samples 23–25 (after addition of the additives) the fuel mixture was pre-heated to 140° C. for 6 minutes before the addition of further water as denoted in the table and casting using the drum caster. Sample 26 was not subjected to pre-treatment before casting.

The fuel material of the present invention exhibits good taste and flavour characteristics, lower static peak burning temperatures, lower sidestream smoke and a more localised burn zone. All of these features are improvements over prior proposed tobacco substitute materials or alternative smokable filler materials. The low sidestream smoke characteristics can be enhanced by careful selection of the cigarette wrapper utilised in the smoking article.

TABLE 1

Composition of Fuels used for Smoking Purposes

| | Licorice | Cocoa | PG | Glycerol | SUGAR (%) | | | | Honey | St. John's Bread | Tartaric Acid | PGA | Chalk |
|---|---|---|---|---|---|---|---|---|---|---|---|---|---|
| No. | (%) | (%) | (%) | (%) | Cane | Invert | Fruit | Demerera | (%) | (%) | (%) | (%) | (%) |
| 1 | 5 | 5 | 0 | 13 | 0 | 6 | 0 | 7 | 0 | 0 | 0 | 10 | 54 |
| 2 | 5 | 5 | 0 | 13 | 0 | 2 | 0 | 2.3 | 0 | 0 | 0 | 10 | 62.7 |
| 3 | 5 | 5 | 0 | 13 | 0 | 12 | 0 | 14 | 0 | 0 | 0 | 10 | 41 |
| 4 | 5 | 5 | 0 | 13 | 6 | 0 | 0 | 7 | 0 | 0 | 0 | 10 | 54 |
| 5 | 5 | 5 | 0 | 13 | 0 | 0 | 6 | 7 | 0 | 0 | 0 | 10 | 54 |
| 6 | 5 | 5 | 0 | 13 | 0 | 0 | 0 | 7 | 6 | 0 | 0 | 10 | 54 |
| 7 | 5 | 5 | 0 | 13 | 0 | 6 | 0 | 6 | 0 | 0 | 0 | 10 | 55 |
| 8 | 5 | 5 | 0 | 13 | 0 | 6 | 6 | 0 | 0 | 0 | 0 | 10 | 55 |
| 9 | 5 | 5 | 0 | 13 | 6 | 6 | 0 | 0 | 0 | 0 | 0 | 10 | 55 |
| 10 | 5 | 5 | 0 | 13 | 0 | 6 | 0 | 0 | 6 | 0 | 0 | 10 | 55 |
| 11 | 5 | 5 | 13 | 0 | 0 | 6 | 0 | 7 | 0 | 0 | 0 | 10 | 54 |
| 12 | 5 | 5 | 6.5 | 6.5 | 0 | 6 | 0 | 7 | 0 | 0 | 0 | 10 | 54 |
| 13 | 15 | 5 | 0 | 13 | 0 | 6 | 0 | 7 | 0 | 0 | 0 | 10 | 44 |
| 14 | 5 | 15 | 0 | 13 | 0 | 6 | 0 | 7 | 0 | 0 | 0 | 10 | 44 |
| 15 | 10 | 10 | 0 | 13 | 0 | 6 | 0 | 7 | 0 | 0 | 0 | 10 | 44 |
| 16 | 10 | 0 | 0 | 13 | 0 | 6 | 0 | 7 | 0 | 0 | 0 | 10 | 54 |
| 17 | 0 | 10 | 0 | 13 | 0 | 6 | 0 | 7 | 0 | 0 | 0 | 10 | 54 |
| 18 | 5 | 5 | 0 | 13 | 0 | 6 | 6 | 6 | 0 | 0 | 0 | 10 | 55 |
| 19 | 5 | 50 | 0 | 13 | 0 | 6 | 0 | 7 | 0 | 0 | 0 | 10 | 19 |
| 20 | 5 | 5 | 0 | 13 | 0 | 6 | 0 | 7 | 0 | 0 | 0 | 10 | 54 |

TABLE 1-continued

Composition of Fuels used for Smoking Purposes

| No. | Licorice (%) | Cocoa (%) | PG (%) | Glycerol (%) | SUGAR (%) Cane | Invert | Fruit | Demerera | Honey (%) | St. John's Bread (%) | Tartaric Acid (%) | PGA (%) | Chalk (%) |
|---|---|---|---|---|---|---|---|---|---|---|---|---|---|
| 21 | 5 | 5 | 0 | 13 | 0 | 6 | 0 | 7 | 0 | 1 | 1 | 10 | 52 |

PG—Propylene Glycol
PGA—Propylene Glycol Alginate

TABLE 2

Deliveries and Static Peak Temperatures (SPT)

| Sample No. | Outer Wt (g) | Fuel Wt (g) | TPM (mg) | Puff Number | SPT (° C.) |
|---|---|---|---|---|---|
| 1 | 0.4676 | 0.9385 | 12.2 | 14 | |
| 2 | 0.4169 | 1.0447 | 15.2 | 15 | 712 |
| 3 | 0.4238 | 1.0193 | 18.6 | 15 | 750 |
| 4 | 0.4412 | 0.8781 | 17.9 | 15 | 712 |
| 5 | 0.4603 | 0.8668 | 16.0 | 15 | 717 |
| 6 | 0.4554 | 0.8606 | 12.1 | 15 | 739 |
| 7 | 0.3795 | 1.0341 | 16.6 | 14 | 759 |
| 8 | 0.4506 | 0.811 | 15.7 | 14 | 770 |
| 9 | 0.4281 | 0.9622 | 10.7 | 8 | 725 |
| 10 | 0.4274 | 1.0604 | 20.3 | 15 | 773 |
| 11 | 0.4234 | 0.8621 | 14.4 | 15 | |
| 12 | 0.4389 | 0.9962 | 14.6 | 15 | |
| 13 | 0.4250 | 0.9323 | 7.5 | 13 | |
| 14 | 0.4458 | 1.0939 | 27.7 | 15 | |
| 15 | 0.4772 | 1.0295 | 12.0 | 15 | |
| 16 | 0.4582 | 0.7873 | 8.8 | 15 | |
| 17 | 0.4071 | 0.9655 | 21.2 | 15 | |
| 18 | 0.4882 | 1.042 | 27.0 | 15 | |
| 19 | 0.4902 | 0.934 | 31.6 | 20 | |
| 20 | 0.4298 | 0.9868 | 24.2 | 20 | |
| 21 | 0.4505 | 0.8195 | 15.1 | 20 | |

TABLE 3

| Material (g) | Sample No. 20 | 21 | 22 |
|---|---|---|---|
| Licorice (spray dried) | 10 | — | — |
| Cocoa | — | — | 10 |
| Sugar (demerara) | — | 10 | — |
| Glycerol | 13 | 13 | 13 |
| Water (ml) | 360 | 400 | 440 |
| PGA | 10 | 10 | 10 |
| Chalk | 67 | 67 | 67 |
| Smoke data | | | |
| Fuel weight in cigarette (g) | 0.86 | 1.01 | 0.87 |
| Puff Number | 6 | 7 | 6 |
| Smoke Delivery (wet tar) (mg) | 8.1 | 11.7 | 9.6 |

TABLE 4

| Material (g) | Sample No. 23 | 24 | 25 | 26 |
|---|---|---|---|---|
| Licorice (spray dried) | 5 | 5 | 5 | 5 |
| Cocoa | 5 | 5 | 5 | 5 |
| Sugar | 13 | 13 | 13 | 13 |
| Glycerol | 13 | 13 | 13 | 13 |
| PGA | 10 | 10 | 10 | 10 |

TABLE 4-continued

| Material (g) | Sample No. 23 | 24 | 25 | 26 |
|---|---|---|---|---|
| Chalk | 49 | 53 | 53.5 | 49 |
| Tobacco dust | 5 | — | — | 5 |
| Tobacco extract | — | 1 | — | — |
| Tobacco extract fraction - synthetic analogue | — | — | 0.5 | — |
| Water (ml) | 270 | 245 | 250 | 340 |
| Smoke Data | | | | |
| Fuel weight in cigarette (g) | 1.37 | 1.30 | 1.29 | 1.05 |
| Puff Number | 11 | 9 | 9 | 8 |
| Smoke delivery (wet tar) (mg) | 14.8 | 12.9 | 10.4 | 11.4 |

I claim:

1. A smoking article smokable filler material comprising a non-tobacco fuel material comprising 10–70% by weight casing materials, 30–80% by weight of a substantially non-combustible inorganic filler, 10–30% by weight of an aerosol generating source, and 5–25% by weight binder, said casing materials being at least licorice and/or cocoa casing materials.

2. A smoking article smokable filler material comprising a non-tobacco fuel material comprising two or more casing materials, a substantially non-combustible inorganic filler, an aerosol generating source, a binder, optionally carbon and optionally an expansion medium, the smokable filler material comprising about 10% to about 70% by weight casing material, about 10% to about 30% by weight aerosol generating source, about 30% to about 80% by weight inorganic filler material, about 5% to about 25% by weight binder, 0 to about 30% by weight expansion medium and 0 to about 20% by weight carbon, and wherein sugar is one of the two or more casing materials, and the total amount of sugar is present at less than 15% by weight of said smokable filler material.

3. A smokable filler material according to any one of claim 1 or claim 2 further comprising an organic filler material.

4. A smokable filler material according to any one of claim 1 or claim 2 wherein the casing material is less than 50%.

5. A smokable filler material according to any one of claim 1 or claim 2 wherein the filler material is a substantially non-tobacco material containing about 5% or less tobacco material by weight of the filler.

6. A smokable filler material according to any one of claim 1 or claim 2 wherein at least one of the group consisting of tobacco extract material and tobacco identical amino acids are included in the filler material.

7. A smokable filler material according to any one of claim 1 or claim 2 wherein the non-combustible inorganic material is selected from the group consisting of chalk, perlite, vermiculite, diatomaceous earth, colloidal silica, magnesium oxide, magnesium sulphate and non-combustible, inorganic filler materials having a density similar to the materials cited in the group.

8. A smokable filler material according to any one of claim 1 or claim 2, wherein the binder is either an organic binder selected from the group consisting of a cellulosic or cellulosic derivative binder, an alginic or pectinaceous binder, a gum or a gel, or an inorganic, non-combustible binder, including potassium silicate, magnesium oxide in combination with potassium silicate, or cements, and mixtures thereof.

9. A smokable filler material according to any one of claim 1 or claim 2, wherein the aerosol generating source comprises one selected from the group consisting of polyhydric alcohols, propylene glycol, triethylene glycol, glycerol, esters and high boiling point hydrocarbons.

10. A smokable filler material according to any one of claim 1 or claim 2, wherein said suitable expansion medium is selected from the group consisting of starch, pullulan or other polysaccharides, solid foaming agents, inorganic salts and organic acids providing in situ gaseous agents, organic gaseous agents, inorganic gaseous agents and volatile liquid foaming agents.

11. A smokable filler material according to claim 10, wherein said polysaccharides include cellulose derivatives.

12. A smokable filler material according to claim 1, wherein further casing material is selected from the group consisting of sugars; humectants; distilled water, coffee, vanillin, apple derivatives, clove, St. John's Bread, and organic acids.

13. A smokable filler material according to claim 12, wherein said sugar is selected from the group consisting of cane sugar, invert sugar, fruit sugar from fruit juices, demerara sugar, maple sugar, sucrose, honey, caramel and molasses, said humectant is selected from the group consisting of propylene glycol, glycerol, diethylene glycol, butylene glycol and sorbitol and said organic acid is selected from the group consisting of citric acid and tartaric acid.

14. A smoking article comprising smokable filler according to any one of claim 1 or claim 2, wherein said filler is wrapped in a paper wrapper or in a substantially non-combustible wrapper comprising predominantly non-combustible, inorganic filler material, a binder and/or a plasticiser, and optionally a small amount of fibre.

15. A smoking article according to claim 14, wherein said non-combustible, inorganic filler material is particulate.

16. A smokable filler material according to claim 1, wherein when sugar is one of the casing materials, the total amount of sugar is present at less than 15% by weight of said smokable filler material.

17. A smokable filler material according to claim 2, wherein the casing material is selected from one or more of the group consisting of sugars; humectants; distilled water, licorice, coffee, vanillin, apple derivatives, clove, cocoa, St. John's Bread, and organic acids.

18. A smokable filler material according to claim 17, wherein said sugar is selected from the group consisting of cane sugar, invert sugar, fruit sugar from fruit juices, demerara sugar, maple sugar, sucrose, honey, caramel and molasses; and said humectant is selected from the group consisting of propylene glycol, glycerol, diethylene glycol, butylene glycol and sorbitol and said organic acid is selected from the group consisting of citric acid and tartaric acid.

19. A smokable filler material according to claim 2, wherein top flavor compositions are also utilized in the smokable filler material.

* * * * *